US006604939B1

(12) United States Patent
Li

(10) Patent No.: US 6,604,939 B1
(45) Date of Patent: Aug. 12, 2003

(54) PIEZOELECTRIC LIGHTER WITH SAFETY ARRANGEMENT

(76) Inventor: Kin Chung Li, 2211 S. Hacienda Blvd., Suite 107, Hacienda Heights, CA (US) 91754

( * ) Notice: Subject to any disclaimer, the term of this patent is extended or adjusted under 35 U.S.C. 154(b) by 0 days.

(21) Appl. No.: 10/138,818

(22) Filed: May 6, 2002

(51) Int. Cl.[7] ..... F23D 11/36; F23Q 7/12
(52) U.S. Cl. ..... 431/153; 431/255
(58) Field of Search ..... 431/153, 255, 431/344, 277, 276, 254, 310

(56) References Cited

U.S. PATENT DOCUMENTS 5,997,282 A * 12/1999 Man ..... 431/153
6,086,358 A * 7/2000 Potskhishvili ..... 431/153
6,135,763 A * 10/2000 Man ..... 431/255

* cited by examiner

*Primary Examiner*—James C. Yeung
(74) *Attorney, Agent, or Firm*—Raymond Y. Chan; David and Raymond Patent Group

(57) ABSTRACT

A piezoelectric lighter incorporates with a safety arrangement which includes an ignition button, having an actuating cavity, slidably mounted on the casing in a vertically movable manner, an actuating member including a pusher arm extended into the actuating cavity, and a resilient element disposed between the pusher arm and the ignition button for applying an urging pressure against the pusher arm so as to normally retain the pusher arm in a safety position. In the safety position, the pusher arm is positioned away from the depressible end of the gas lever with a predetermined distance, and in the ignition position, the pusher arm is moved to a position that when the ignition button is depressed downwardly, the pusher arm is driven downwardly to depress the depressible end of the gas lever for releasing gas, so as to ignite the piezoelectric lighter.

1 Claim, 6 Drawing Sheets

PIEZOELECTRIC LIGHTER WITH SAFETY ARRANGEMENT

BACKGROUND OF THE PRESENT INVENTION

1. Field of Invention

The present invention relates to a piezoelectric lighter, and more particularly to a piezoelectric lighter with a safety arrangement, wherein the pusher arm is normally disengaged with the gas lever which drives the gas releasable valve for releasing gas, so as to prevent the piezoelectric lighter from being ignited accidentally of by children.

2. Description of Related Arts

Piezoelectric lighters have been known and sold throughout the United States. The conventional push-down type piezoelectric lighter generally comprises a fuel tank, a gas valve communicating with the fuel tank for releasing gas therein, and a piezoelectric unit for generating piezoelectricity when it is compressed. In order to ignite the piezoelectric lighter, a pusher button must be pressed downwardly to compress the piezoelectric unit for producing a spark. At the same time, one end of a gas lever is depressed by the pusher button to pivotally lift up another end which is engaged with the gas valve for releasing gas. Therefore, the spark from the piezoelectric unit will ignite the emitting gas to ignite the piezoelectric lighter.

For safety reasons, both the government and the consumers in United States demand a safety device employed in every lighter to prevent unwanted ignition accidentally or by a child. One of the most common ways to incorporate the piezoelectric lighter with the safety device is to lock up the pusher button in a vertically movable manner, so as to prevent the pusher button from being pressed downwardly to ignite the piezoelectric lighter. However, the operation of such safety device is unreliable.

Since the downward movement of the pusher button is locked up at the locking position, once the pusher button is depressed downwardly, the piezoelectric lighter will be ignited. In other words, the child may easily to figure out how to unlock the piezoelectric lighter.

In order to stop the child from the usage of the piezoelectric lighter, a complicated safety device must be used. However, this adverse result affects the ease of operating the safety device and leads to different operational results depending on the users. Moreover, such safety device will highly increase the manufacturing cost of the piezoelectric lighter. Therefore, such safety device can be considered disadvantageous in practical use.

SUMMARY OF THE PRESENT INVENTION

A main object of the present invention is to provide a piezoelectric lighter with a safety arrangement, wherein the pusher arm of the safety arrangement is normally disengaged with the gas lever which drives the gas releasable valve for releasing gas, so as to prevent the piezoelectric lighter from being ignited accidentally of by children.

Another object of the present invention is to provide a piezoelectric lighter with a safety arrangement, wherein in order to ignite the piezoelectric lighter, the user must move the pusher arm to the gas lever and then depress the ignition button. In other words, no gas is released when only depressing the ignition button, so as to prevent the piezoelectric lighter from being ignited accidentally or by children.

Another object of the present invention is to provide a piezoelectric lighter with a safety arrangement, wherein the piezoelectric lighter not only normally retains a safety condition but also automatically return to the safety condition after each ignition operation so as to prevent any unintentional ignition of the piezoelectric lighter.

Another object of the present invention is to provide a piezoelectric lighter with a safety arrangement, which does not require to alter the original structure design of the piezoelectric lighter, so as to minimize the manufacturing cost of incorporating the safety arrangement with every conventional piezoelectric lighter having an ignition button and a gas lever.

Accordingly, in order to accomplish the above objects, the present invention provide a piezoelectric lighter, comprising:

- a casing having a liquefied gas storage;
- a gas emitting nozzle disposed in the casing and communicating with the liquefied gas storage via a gas releasable valve;
- a gas lever, which is pivotally supported in the casing, having a lifting end engaged with the gas releasable valve and a depressible end arranged in such a manner that when the depressible end of the gas lever is depressed, the lifting end of the gas lever lifts up the gas releasable valve for releasing gas from the liquefied gas storage;
- a piezoelectric unit, which is disposed in the casing for generating piezoelectricity, comprising a movable operating part extended upwardly and an ignition tip extended to a position close to the gas emitting nozzle; and
- a safety arrangement, comprising:
  - an ignition button, having an actuating cavity, slidably mounted on the casing in a vertically movable manner wherein the ignition button is attached to a top end of the piezoelectric unit and arranged in such a manner that when the ignition button is pushed downwardly, the movable operating part of the piezoelectric unit is depressed;
  - an actuating member comprising a pusher arm extended into the actuating cavity and adapted to move from a safety position to an ignition position; and
  - a resilient element disposed between the pusher arm and the ignition button for applying an urging pressure against the pusher arm so as to normally retain the pusher arm in the safety position, wherein in the safety position, the pusher arm is positioned away from the depressible end of the gas lever with a predetermined distance, and in the ignition position, the pusher arm is moved to a position that when the ignition button is depressed downwardly, the pusher arm is driven downwardly to depress the depressible end of the gas lever for releasing gas, so as to ignite the piezoelectric lighter.

In order to ignite the piezoelectric lighter, the pusher arm is required to operate to the ignition position by moving the pusher arm toward the depressible end of the gas lever, so that the ignition button is slid downwardly to drive the pusher arm downward so as to depress depressible end of the gas lever for releasing gas. At the same time, the piezoelectric unit is depressed to generate sparks to ignite the gas emitted from the gas emitting nozzle of the piezoelectric lighter.

DETAILED DESCRIPTION OF THE PREFERRED EMBODIMENT

Figure 1:
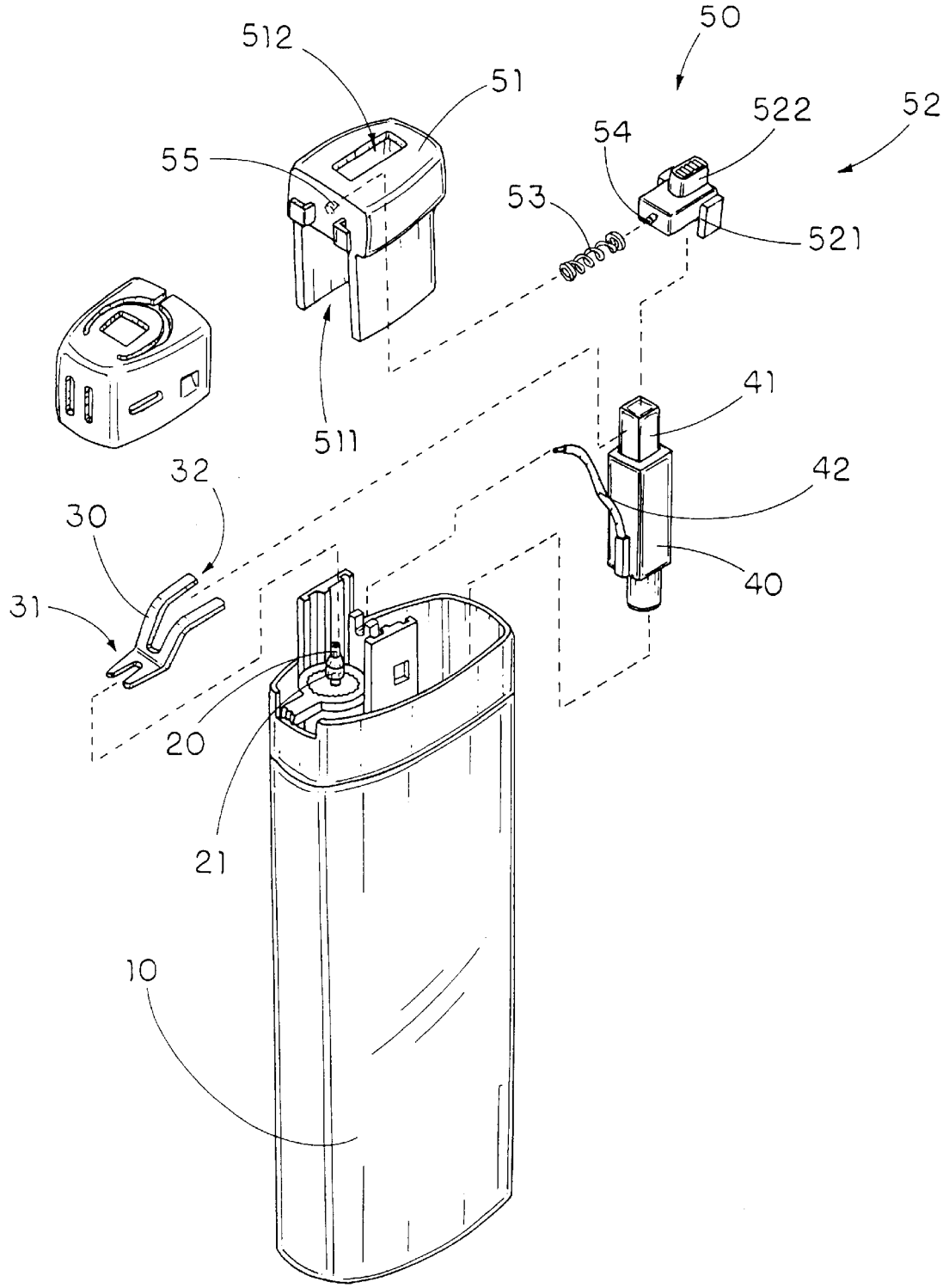
FIG. 1 is an exploded perspective view of a piezoelectric lighter with a safety arrangement according to a first preferred embodiment of the present invention.
Figure 2:
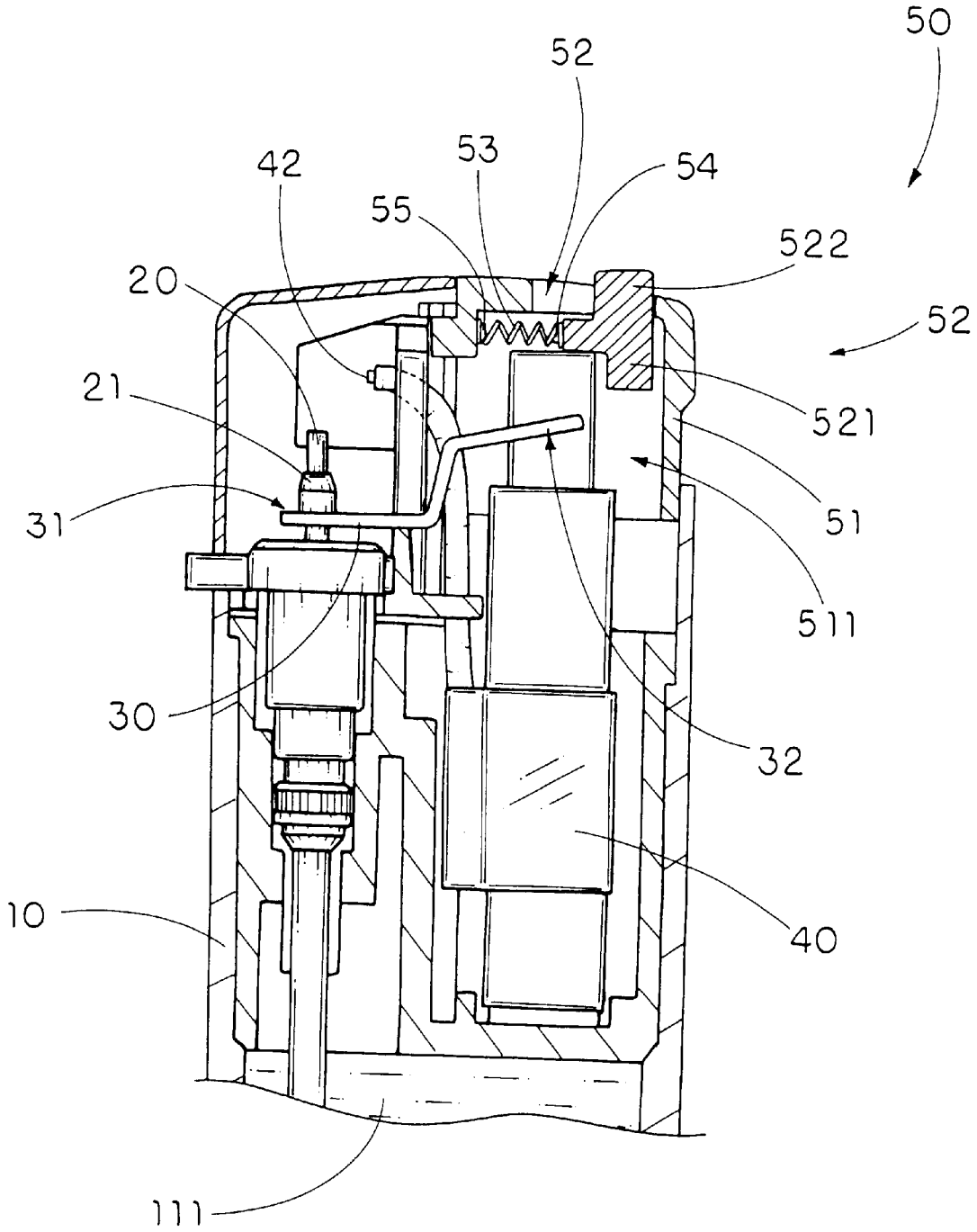
FIG. 2 is a sectional view of the safety arrangement of the piezoelectric lighter in a safety position according to the above first preferred embodiment of the present invention.

Referring to FIGS. 1 and 2 of the drawings, a piezoelectric lighter according to a first preferred embodiment of the present invention is illustrated, wherein the piezoelectric lighter, such as a standard piezoelectric lighter, comprises a casing 10 having a liquefied gas storage 111 and a gas emitting nozzle 20 disposed in the casing 10 and communicating with the liquefied gas storage 111 via a gas releasable valve 21.

A gas lever 30, which is pivotally supported in the casing 10, has a lifting end 31 engaged with the gas releasable valve 21 and a depressible end 32 arranged in such a manner that when the depressible end 32 of the gas lever 30 is depressed, the lifting end 31 of the gas lever 30 lifts up the gas releasable valve 21 for releasing gas from the liquefied gas storage 111 toward the gas emitting nozzle 20.

A piezoelectric unit 40, which is disposed in the casing 10 for generating piezoelectricity, comprises a movable operating part 41 extended upwardly and an ignition tip 42 extended to a position close to the gas emitting nozzle 20, wherein when the movable operating part 41 is depressed downwardly, the ignition tip 42 generates sparks to ignite the gas emitted from the gas emitting nozzle 20.

The piezoelectric lighter further comprises a safety arrangement 50 which comprises an ignition button 51, an actuating member 52, and a resilient element 53.

The ignition button 51, having an actuating cavity 511 , is slidably mounted on the casing 10 in a vertically movable manner wherein the ignition button 51 is attached to a top end of the piezoelectric unit 40 and arranged in such a manner that when the ignition button 51 is pushed downwardly, the movable operating part 41 of the piezoelectric unit 40 is depressed. The ignition button 51 further has an operation slot 512 provided on a top wall of the ignition button to communicate the actuating cavity 511 with outside.

The actuating member 52 comprises a pusher arm 521 extended into the actuating cavity 511 and adapted to move from a safety position to an ignition position.

The resilient element 53 is disposed between the pusher arm 521 and the ignition button 51 for applying an urging pressure against the pusher arm 521 so as to normally retain the pusher arm 521 in the safety position. In which, in the safety position, the pusher arm 521 is positioned away from the depressible end 32 of the gas lever 30 with a predetermined distance, and in the ignition position, the pusher arm 521 is moved to a position that when the ignition button 51 is depressed downwardly, the pusher arm 521 is driven downwardly to depress the depressible end 32 of the gas lever 30 for releasing gas, so as to ignite the piezoelectric lighter.

According to the preferred embodiment, the actuating member 52 further comprises an operation button 522 slidably mounted on the ignition button 51 wherein the pusher arm 521 is extended from the operation button 522 to the actuating cavity 511 through the operation slot 512 in such a manner that the operation button 522 is arranged to move the pusher arm 521 from the safety position to the ignition position.

As shown in FIG. 1, the operation slot 512 is formed on the top wall of the ignition button 51 wherein the operation button 522 is slidably mounted on the top wall of the ignition button 51 and is arranged to drive the pusher arm 521 toward the depressible end 32 of the gas lever 30 for ignition. Accordingly, an upper portion of the pusher arm 521, which functions as the operation button 522, is extended out of the actuating cavity 511 through the operation slot 512.

The pusher arm 521 is downwardly extended from the operation button 522 to the actuating cavity 511 through the operation slot 512, wherein, a bottom portion of the pusher arm 521 functions as a pusher head adapted to depress the depressible end 32 of the gas lever 30 for releasing gas at the ignition position.

Figure 3:
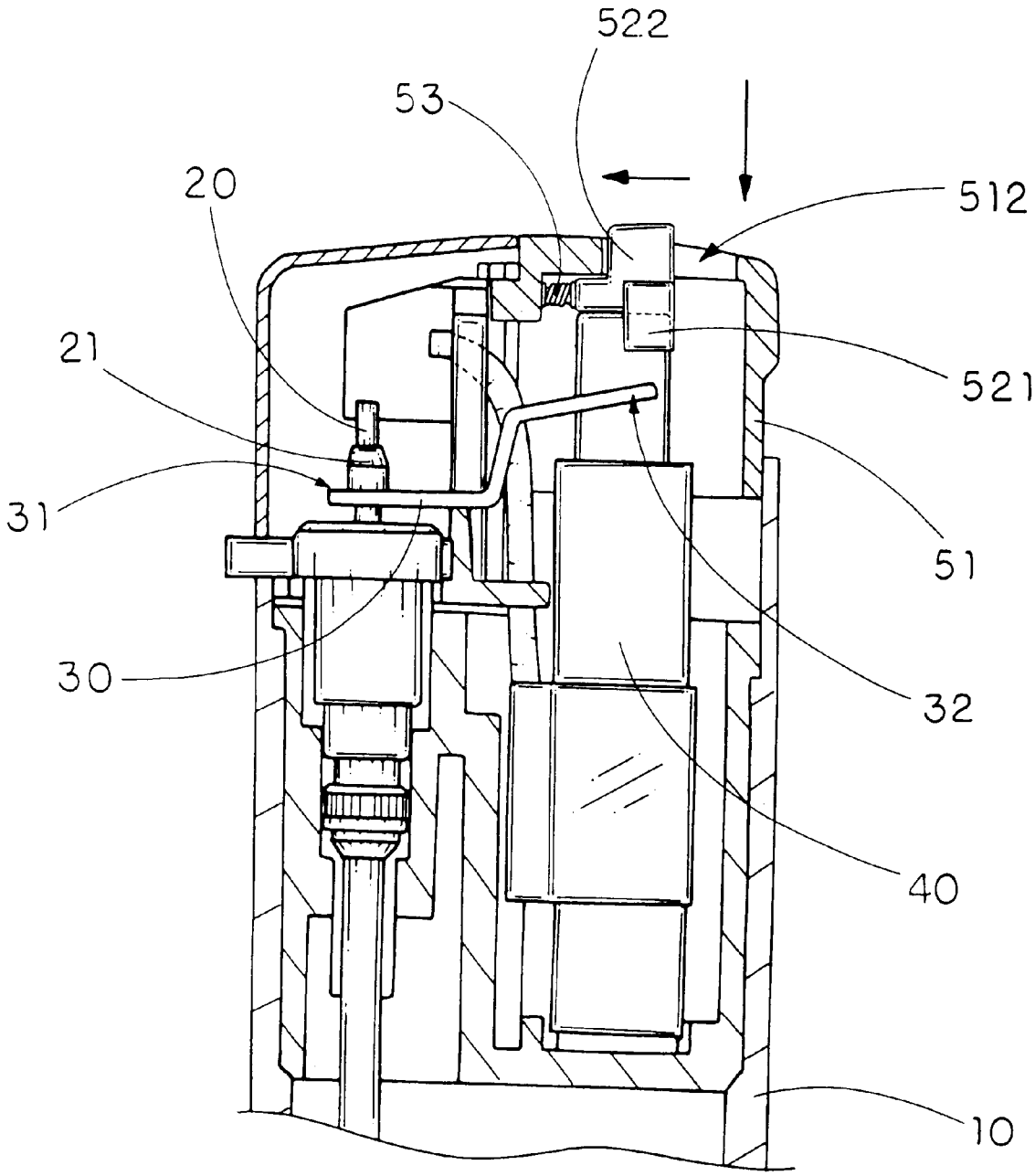
FIG. 3 is a sectional view of the safety arrangement of the piezoelectric lighter in an ignition position according to the above first preferred embodiment of the present invention.

As shown in FIG. 2, in the safety position, the bottom portion of the pusher arm 521 is positioned away from the depressible end 32 of the gas lever 30 with a predetermined distance in such a manner that when the ignition button 51 is depressed downwardly to drive the pusher arm 521 downward, the position of the gas lever 30 is remained unchanged, so that no gas is released to the gas emitting nozzle 20. In the ignition position, as shown in FIG. 3, the pusher arm 521 is moved at a position that the bottom portion thereof is positioned above the depressible end 32 of the gas lever 30 in such a manner that when the ignition button 51 is depressed downwardly to drive the pusher arm 521 downward, the depressible end 32 of the gas lever 30 is depressed downwardly by the pusher arm 521 for releasing gas.

Therefore, in the safety position, even though the ignition button 51 is adapted to be pressed downwardly to compress the piezoelectric unit 40, the piezoelectric lighter cannot be ignited since no gas is released. In other words, the safety arrangement 50 can prevent the piezoelectric lighter from being ignited accidentally or by children.

The resilient element 53, according to the preferred embodiment, is a compression spring disposed in the actuating cavity 511 for applying an urging pressure against the pusher arm 521 so as to normally retain the pusher arm 521 at the safety position. As shown FIG. 2, the resilient element 53 is provided between the pusher arm 521 and an inner wall of the actuating cavity 511. The resilient element 53 has two ends biasing against the pusher arm 521 and the inner wall of the actuating cavity 511 in such a manner that the resilient element 53 normally urges and retains the pusher arm 521 in a rearward position that the bottom portion of the pusher arm 521 is misalign with the depressible end 32 of the gas lever 30 to prevent the gas released by the gas lever 30 when the ignition button 51 is pressed downwardly.

Moreover, the safety arrangement 50 further comprises a first holder 54 protruded from the pusher arm 521 and a second holder 55 protruded from the inner wall of the actuating cavity 511, wherein the first holder 54 and the second holder 55 are adapted to engage with two ends of the resilient element 53 respectively so as to securely hold the resilient element 53 between the pusher arm 521 and the inner wall of the actuating cavity 511. Accordingly, the first and second holders 54, 55, each having a rod-like shape, are adapted to insert into the two ends of the resilient element 53 respectively.

In order to ignite the piezoelectric lighter, the user must intentionally push the operation button 522 frontwardly so as to move the pusher arm 521 to a position that the bottom portion thereof is positioned aligning above the depressible end 32 of the gas lever 30, i.e. the ignition position of the piezoelectric lighter. At the same time, a downward force must be applied on the ignition button 51 to drive the pusher arm 521 downwardly so as to depress the depressible end 32 of the gas lever 30 for releasing gas. Therefore, the movable operating part 41 of the piezoelectric unit 40 is compressed to generate the sparks through the ignition tip 42 for igniting the emitted gas through the gas emitting nozzle 20.

After the piezoelectric lighter is ignited, the user may release the depressing of the ignition button 51 in such a manner that the compressed piezoelectric unit 40 will rebound to its original form which pushes the ignition button 51 upwardly back to the original position. Furthermore, the compressed resilient element 53 will then rebound rearwardly and force the pusher arm 521 to move away from the depressible end 32 of the gas lever 30 at its safety position.

Figure 4:
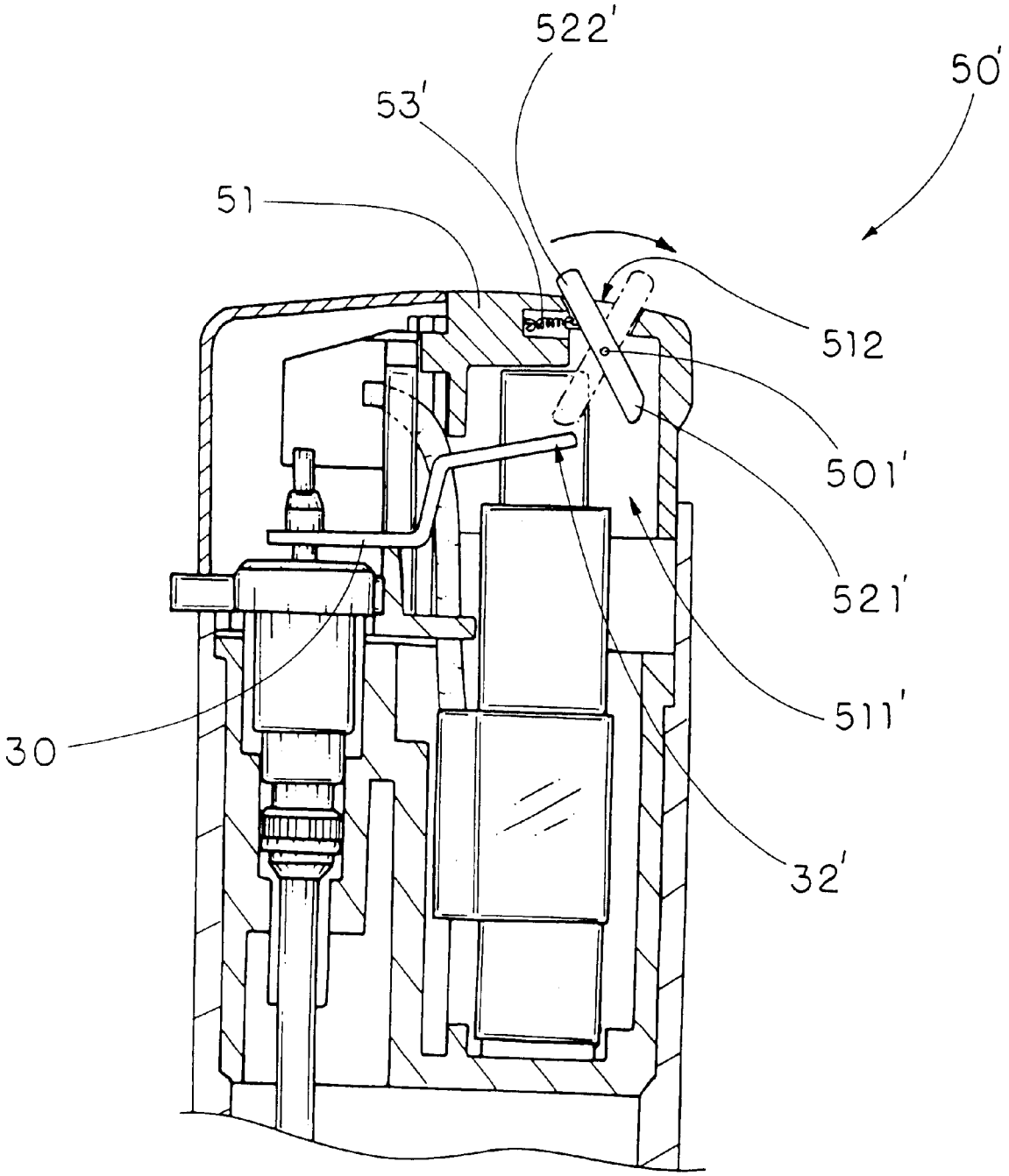
FIG. 4 illustrates an alternative mode of an actuating unit of the safety arrangement of the piezoelectric lighter according to the above first preferred embodiment of the present invention.

FIG. 4 illustrates an alternative mode of the safety arrangement 50' wherein the pusher arm 521' is modified to pivotally mounted in the actuating cavity 511' by a pivot pin 501' in such a manner that the bottom portion of the pusher arm 521' is arranged to pivotally move to depress the depressible end 32' of the gas lever 30' at the ignition position.

As shown in FIG. 4, an upper portion of the pusher arm 521' is extended from the actuating cavity 511' to outside through the operation slot 512' wherein the upper portion of the pusher arm 521' functions as the operation button 522' to pivotally move the bottom portion of the pusher arm 521' from the safety position to the ignition position.

The resilient element 53' is disposed in the actuating cavity 511' for applying an urging pressure against the pusher arm 521' so as to normally retain the pusher arm 521' at the safety position. The resilient element 53' has two ends biasing against the pusher arm 521' and the inner wall of the actuating cavity 511' in such a manner that the resilient element 53' normally urges the pusher arm 521' to slightly rotate that the bottom portion of the pusher arm 521' is positioned away from the depressible end 32' of the gas lever 30' to prevent the gas released by the gas lever 30' when the ignition button 51' is pressed downwardly.

To ignite the piezoelectric lighter, the user must push the upper portion of the pusher arm 521' to pivotally move the bottom portion thereof at a position that right above the depressible end 32' of the gas lever 30'. Therefore, the downward movement of the ignition button 51' will drive the pusher arm 521' downwardly to depress the depressible end 32' of the gas lever 30' for releasing gas.

Figure 5:
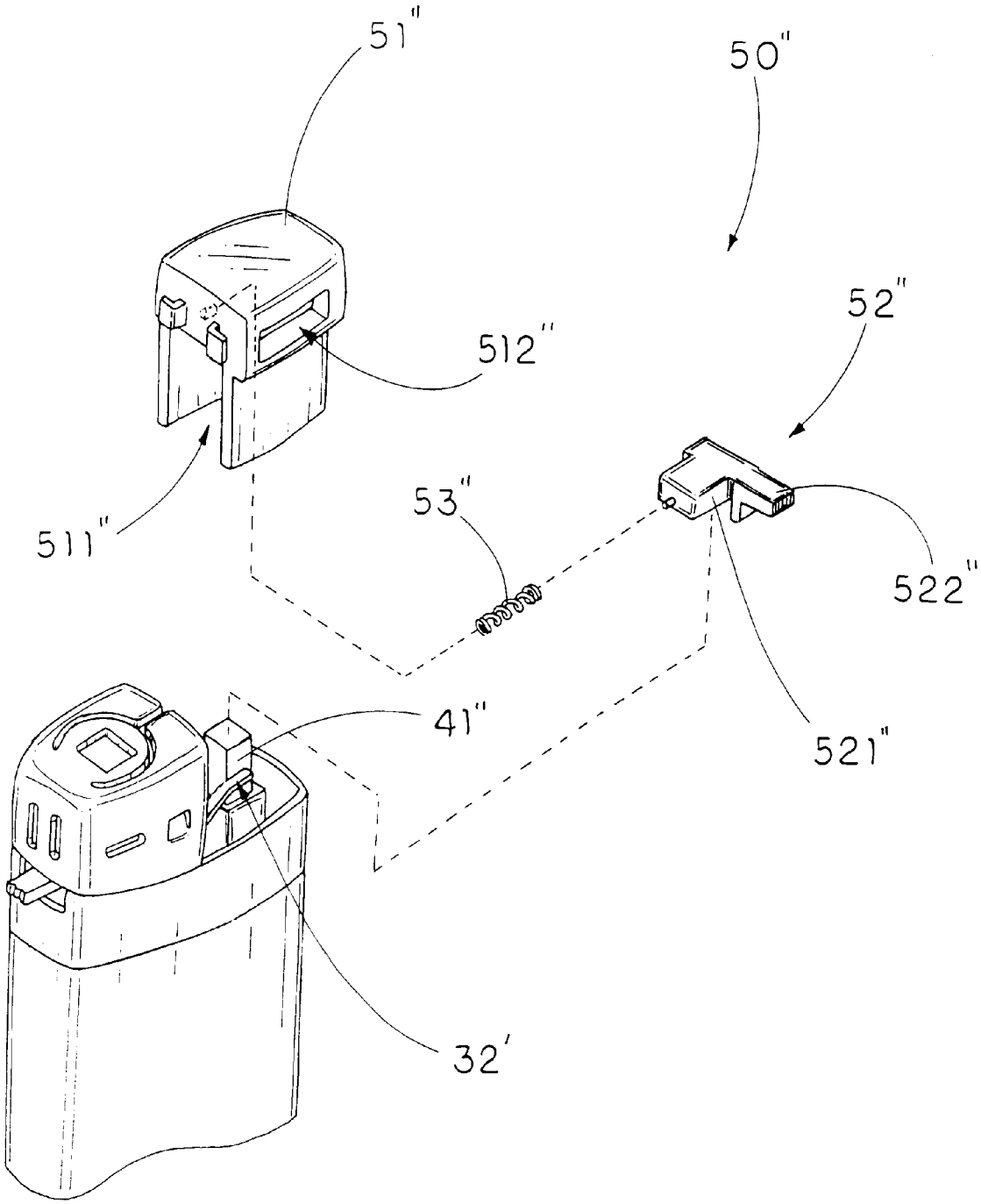
FIG. 5 is a partially exploded perspective view of a piezoelectric lighter with a safety arrangement according to a second preferred embodiment of the present invention.

Referring to FIG. 5, a second preferred embodiment of the piezoelectric lighter illustrates another alternative mode of the safety arrangement 50" wherein the operation slot 512" is provided on a sidewall of the ignition button 51" for communicating the actuating cavity 511" with outside.

Figure 6:
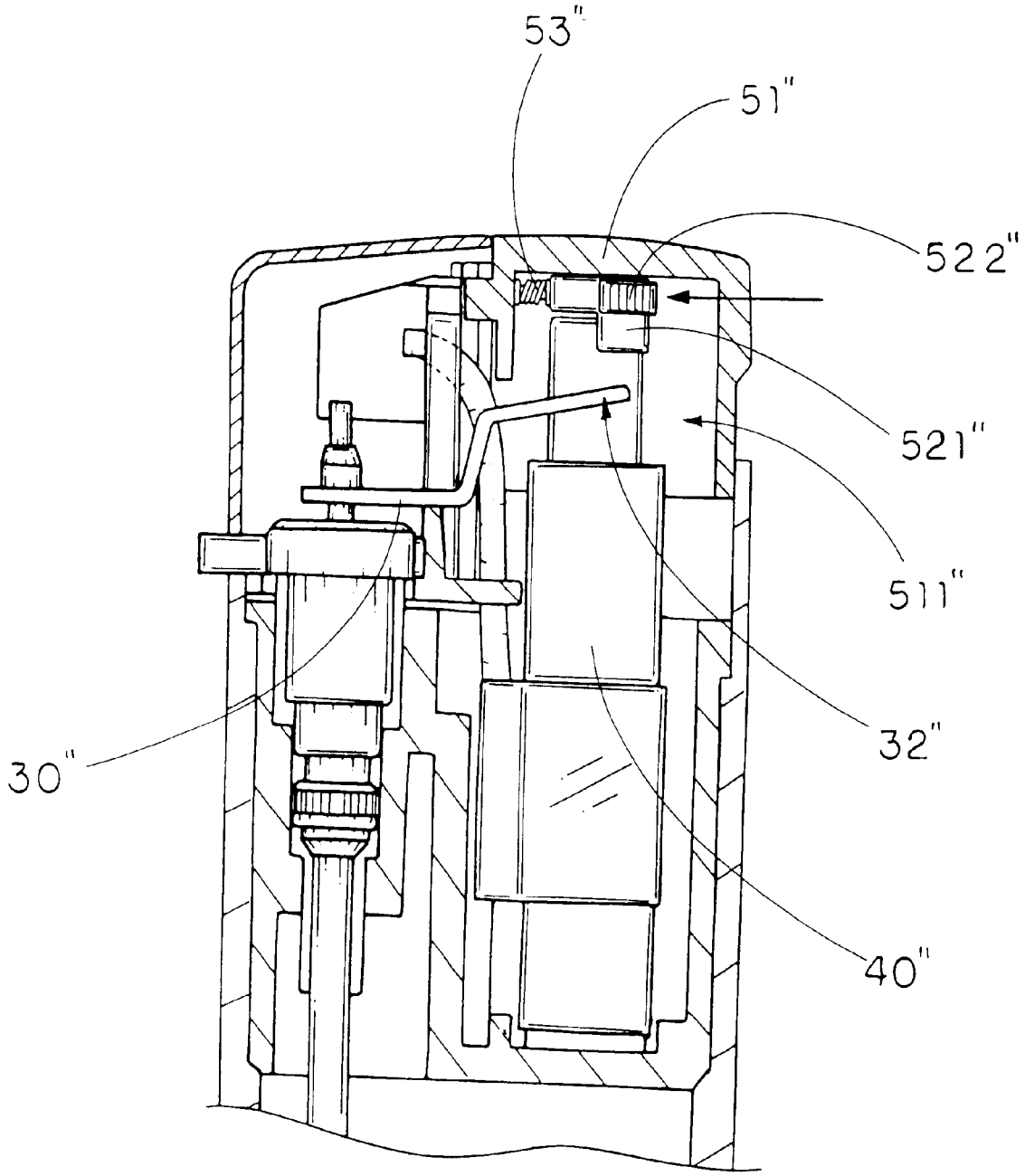
FIG. 6 is a sectional view of the piezoelectric lighter with the safety arrangement in an ignition position according to the above second preferred embodiment of the present invention.

The operation button 522" is slidably mounted on the sidewall of the ignition button 51" wherein the pusher arm 521" is integrally and sidewardly extended from the operation button 522" into the actuating cavity 511" through the operation slot 512" and arranged to be driven by the operation button 522" to move from the safety position to the ignition position. At the safety position, a bottom portion of the pusher arm 521" is positioned away from the depressible end 32" of the gas lever 30" with a predetermined distance in such a manner that the depression of the ignition button 51" will not depress the depressible end 32" of the gas lever 30" by the pusher arm 521" so that the piezoelectric lighter will not be ignited. In the ignition position, as shown in FIG. 6, the pusher arm 521" is moved by the operation button 522" to a position that the bottom portion of the pusher arm 521" is positioned right above the depressible end 32" of the gas lever 30" in such a manner that when the ignition button 51" is depressed, the depression of the pusher arm 521" pushes the depressible end 32" of the gas lever 30" downwardly for releasing gas, so as to ignite the piezoelectric lighter.

The resilient element 53" is disposed in the actuating cavity 511" for applying an urging pressure against the pusher arm 521" so as to normally retain the pusher arm 521" at the safety position. As shown FIG. 6, the resilient element 53" is provided between the pusher arm 521" and an inner wall of the actuating cavity 511". The resilient element 53" has two ends biasing against the pusher arm 521" and the inner wall of the actuating cavity 511" in such a manner that the resilient element 53" normally urges and retains the pusher arm 521" in a rearward position that the bottom portion of the pusher arm 521" is misalign with the depressible end 32" of the gas lever 30" to prevent the gas released by the gas lever 30" when the ignition button 51" is pressed downwardly.

To ignite the piezoelectric lighter, the user must use a lower portion of his or her thumb to frontwardly push the operation button 522", so that the pusher arm 521" will be pushed frontwardly while the bottom portion of the pusher arm 521" is positioned right above the depressible end 32" of the gas lever 30", i.e. the ignition position. Then, the user can use an upper portion of his or her thumb to press the ignition button 51" downwardly to compress the piezoelectric unit 40" and depress the depressible end 32" of the gas lever 30" by the pusher arm 521" at the same time.

What is claimed is:

1. A piezoelectric lighter, comprising:

a casing having a liquefied gas storage;

a gas emitting nozzle disposed in said casing and communicating with said liquefied gas storage via a gas releasable valve;

a piezoelectric unit, which is disposed in said casing for generating piezoelectricity, comprising a movable operating part extended upwardly and an ignition tip extended to a position close to said gas emitting nozzle;

a gas lever, which is pivotally supported in said casing, having a lifting end engaged with said gas releasable valve and a depressible end extended to at least one side of said movable operating part, wherein when said depressible end of said gas lever is depressed, said lifting end of said gas lever lifts up said gas releasable valve for releasing gas from said liquefied gas storage; and a safety arrangement, comprising:

an ignition button, having an actuating cavity, slidably mounted on said casing in a vertically movable manner wherein said ignition button is positioned above a top end of said movable operating part of said piezoelectric unit;

an actuating member which is disposed between said ignition button and said top end of said movable operating part of said piezoelectric unit and arranged in such a manner that when said ignition button is pushed downwardly, said ignition button pushes said actuating member to depress said movable operating part of said piezoelectric unit for producing sparks through said ignition tip, wherein said actuating member comprises a pusher arm, which is downwardly extended into said actuating cavity and adapted to move from a safety position to an ignition position, an operation button which is an upper portion of said pusher arm extended out of said actuating cavity through an operation slot provided on said ignition button so as to slidably mount on said ignition button, and pusher head which is a bottom portion of said pusher arm extended from said operation button to said actuating cavity through said operation slot; and a resilient element which is disposed in said actuating cavity and has two ends biasing against said pusher arm and a front wall of said ignition button respectively for applying an urging pressure against said pusher arm so as to normally push said pusher arm rearwardly to move said pusher head to a safety position behind said movable operating part of said piezoelectric unit, wherein in said safety position, said pusher arm is positioned away from said depressible end of said gas lever with a predetermined distance, such that when said ignition button is depressed to push said pusher arm to depress said movable operating part to produce sparks, said pusher head of said pusher arm remains to have no contact with said gas lever to release gas so that no ignition is performed, wherein when said pusher arm is slid forwards and compresses said resilient element until said pusher head rides on said top end of said movable operating part of said piezoelectric unit and right above said depressible end of said gas lever, said pusher arm is set in an ignition position that when said ignition button is depressed downwardly, said pusher arm is driven downwardly to depress said depressible end of said gas lever for releasing gas so as to ignite said piezoelectric lighter.

* * * * *